United States Patent [19]

Theurer et al.

[11] Patent Number: 4,893,565

[45] Date of Patent: Jan. 16, 1990

[54] MOBILE TRACK SWITCH WORKING MACHINE

[75] Inventors: Josef Theurer, Vienna; Wilhelm Praschl, Linz, both of Austria

[73] Assignee: Franz Plasser Bahnbaumaschinen-Industriegesellschaft m.b.H., Vienna, Austria

[21] Appl. No.: 357,671

[22] Filed: May 22, 1989

Related U.S. Application Data

[63] Continuation of Ser. No. 156,416, Feb. 16, 1988, abandoned.

[30] Foreign Application Priority Data

Feb. 27, 1987 [AT] Austria ..... 445/87
Jul. 8, 1987 [AT] Austria ..... 1722/87

[51] Int. Cl.[4] ..... E01B 27/17
[52] U.S. Cl. ..... 104/7.2; 104/2
[58] Field of Search ..... 104/7.1, 7.2, 2, 10, 104/12

[56] References Cited

U.S. PATENT DOCUMENTS

| | | | |
|---|---|---|---|
| 2,974,607 | 3/1961 | Talboys | 104/7.1 |
| 2,996,016 | 8/1961 | Keller | 104/7.1 X |
| 3,073,258 | 1/1963 | Miller | 104/7.1 |
| 3,732,827 | 5/1973 | Anderson | 104/7.1 |
| 4,248,154 | 2/1981 | Theurer | 104/7.2 |
| 4,322,013 | 4/1982 | Theurer . | |
| 4,323,013 | 4/1982 | Theurer . | |
| 4,342,263 | 8/1982 | Hurni . | |
| 4,457,234 | 7/1984 | Theurer et al. . | |
| 4,627,360 | 12/1986 | Theurer et al. | 104/12 X |
| 4,635,557 | 1/1987 | Mohr et al. | 104/7.2 |
| 4,744,302 | 5/1988 | Theurer et al. | 104/7.2 |

FOREIGN PATENT DOCUMENTS

| | | | |
|---|---|---|---|
| 0364281 | 10/1962 | Switzerland | 104/2 |
| 0887682 | 12/1981 | U.S.S.R. | 104/2 |
| 1011755 | 4/1984 | U.S.S.R. | 104/7.2 |
| 2035423 | 6/1980 | United Kingdom | 104/7.2 |
| 2140061 | 11/1984 | United Kingdom | 104/7.2 |

*Primary Examiner*—Andres Kashnikow
*Assistant Examiner*—Richard Potosnak
*Attorney, Agent, or Firm*—Kurt Kelman

[57] ABSTRACT

A mobile track working machine comprises a machine frame and an apparatus for lifting and laterally moving the track in a switch section, which apparatus comprises a vertically and laterally movable tool carrier frame, power-actuated drives linking the tool carrier frame to the machine frame for vertically and laterally moving the tool carrier frame with respect to the machine frame, a pair of flanged wheels supporting the tool carrier frame for mobility on the track, a respective one of the flanged wheels being associated with each track rail and serving as track lining element, and a respective rail gripping device mounted on the tool carrier frame for engagement with the field side of the associated rail and including a first rail gripping hook transversely and vertically adjustable for engagement with the associated rail and a rail gripping member of a different type for subtending the rail head at the field side of the associated rail. A further transversely and vertically adjustable rail gripping hook is mounted on the tool carrier frame, associated with each rail and spaced from the first rail gripping hook in the operating direction, and independent drives are connected to each rail gripping hook for independent vertical and lateral adjustment thereof.

15 Claims, 3 Drawing Sheets

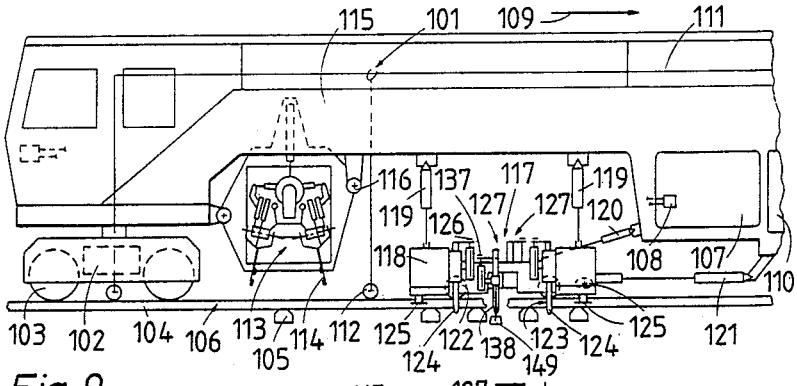
Fig. 9
Fig. 10
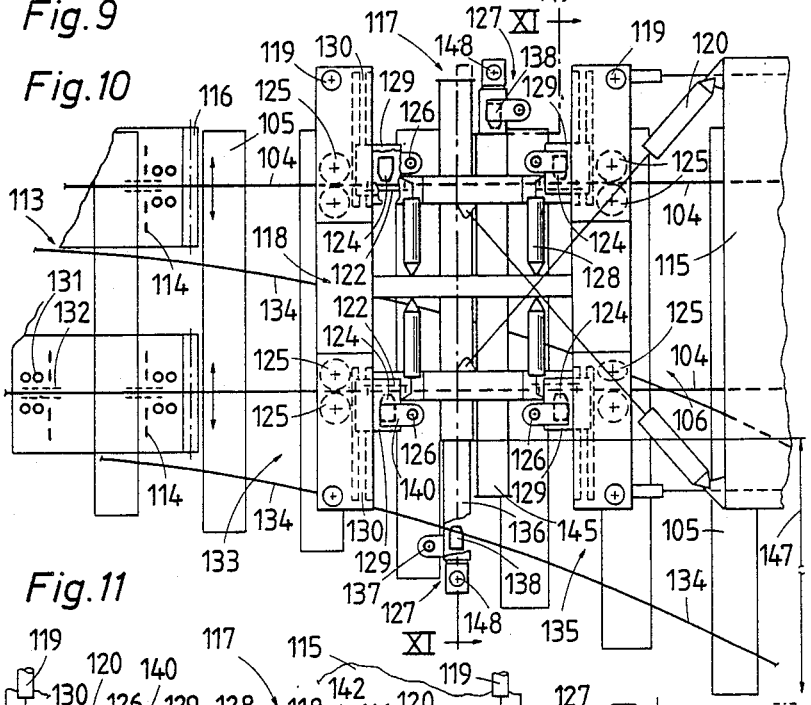
Fig. 11
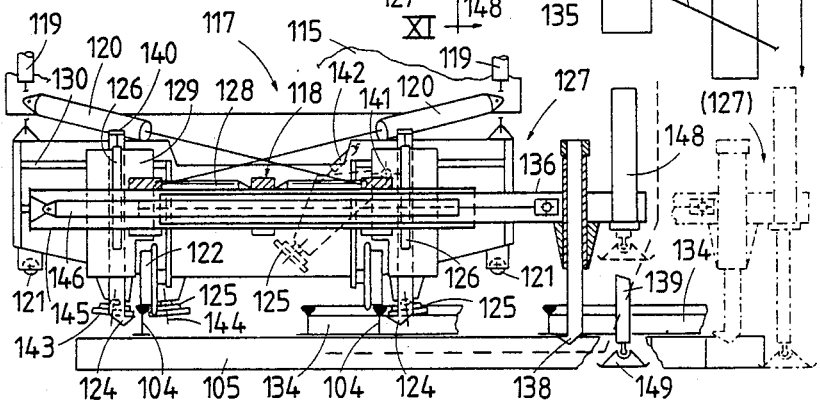

MOBILE TRACK SWITCH WORKING MACHINE

CROSS-REFERENCE TO RELATED APPLICATION

This is a continuation of our copending application Ser. No. 156,416, filed Feb. 16, 1988 now abandoned.

BACKGROUND OF THE INVENTION (1) Field of the Invention

The present invention relates to a mobile track working machine, particularly a track leveling, lining and tamping machine useful for work in switch sections, comprising a machine frame mounted for mobility in an operating direction on a track including two rails fastened to ties defining cribs therebetween, each rail having a rail head, a field side and a gage side, and an apparatus for lifting and laterally moving the track in a switch section. The lifting apparatus comprises a vertically and laterally movable tool carrier frame, power-actuated drives linking the tool carrier frame to the machine frame for vertically and laterally moving the tool carrier frame with respect to the machine frame, and a pair of flanged wheels supporting the tool carrier frame for mobility on the track, a respective one of the flanged wheels being associated with each track rail and serving as track lining element. A respective rail gripping device is mounted on the tool carrier frame for engagement with the field side of the associated rail, the rail gripping device including a first rail gripping hook transversely and vertically adjustable for engagement with the associated rail and a rail gripping member of a different type for grippingly subtending the rail head at the field side of the associated rail.

(2) Description of the Prior Art

U.S. Pat. No. 4,627,360, dated Dec. 9, 1986, discloses a mobile track leveling, lining and tamping machine with tamping tool assemblies and a track lifting and lining unit equipped with tools operable in switch sections of railroad track. The tamping tool assemblies are transversely displaceable and have two or four independently driven tamping tools at the field and gage sides of each rail, each tamping tool being not only reciprocable in the direction of the track but also pivotal in a direction transverse thereto. This enables even very difficult switch sections to be tamped at least with one tamping tool while other tamping tools, which would encounter an obstacle upon immersion in the ballast, are pivoted out of the way. To enable complex and heavy switch sections with their very long ties, and whose rails are difficult to grip, to be leveled and lined, the track lifting and lining unit is longitudinally displaceably supported by two pairs of flanged wheels on the track and has a powerful rail gripping hook associated with each rail, each rail gripping hook being laterally and vertically adjustable by hydraulic cylinder drives. This arrangement enables each rail to be gripped either at the rail head or at the bottom. Such machines are of great importance in track rehabilitation work because the proper leveling and lining of switch sections is of particular value in view of their high construction costs. Suitable leveling and lining systems are used for the control of the lifting and lining tools. However, the accuracy of the track movement, particularly when the track is lifted for leveling, is somewhat impaired because of the weight of the switch section extending to the right or left of the main track and connected thereto by the long ties common to the main track and the track branching off at the switch. Therefore, it is often necessary in the operation of this machine to control the work at the branch track section again by means of the reference system, particularly during track leveling, and then to fix this track section at the accurate level by tamping the ties.

U.S. Pat. No. 4,457,234, dated July 3, 1984, also discloses a track leveling, lining and tamping machine with a track lifting and lining unit which comprises a tool carrier frame linked to the machine frame by a central pole at one end and supported on the track at its opposite end by a pair of flanged wheels. Laterally pivotal rail lifting rollers respectively precede and trail each flanged wheels for engagement with each rail. Two lifting drives and a common lining drive connect the tool carrier frame to the machine frame. The four lifting rollers are transversely aligned in pairs and engage the field sides of the rails. The lifting rollers may be replaced by rotatable mushroom-shaped members for subtending the rail heads or by rail gripping hooks capable of gripping either the rail head or the foot or bottom of the rail. Such a relatively simply constructed machine may be used successfully for work in an initial portion of a track switch but it cannot be operated in the area close to the frog because, as will be explained hereinafter, this requires special rail gripping arrangements.

A mobile track working machine of a similar type and operable in tangent track as well as in switch sections is disclosed in U.S. Pat. No. 4,323,013, dated Apr. 6, 1982. In this machine, two lifting and two lining drives connect the tool carrier frame of the rail lifting and lining unit to the machine frame. Pairs of independently laterally pivotal lifting rollers precede and trail each flanged wheel supporting the tool carrier frame on the associated rail for subtending the rail head at the field and gage side thereof. In addition, a vertically and laterally adjustable rail gripping hook is associated with each rail between the pairs of rail gripping rollers. The combination of the vise-like pairs of pivotal rollers and the hooks gripping each rail, it is possible to work even on the heaviest track switch sections. In one of the embodiments disclosed in this patent, only one gripping roller and one gripping hook is used for each rail for engaging the field side of the rail, the rail gripping hooks being vertically and laterally adjustable. The associated flanged wheel serves as lining element and cooperates selectively with the gripping roller and/or hook, depending on operating conditions, to provide a vise-like grip on the rail, thus serving as a satisfactory track gripping arrangement for most track leveling and lining operations, even in switches. This machine, too, has a leveling and lining reference system. It has been successfully used in commercial operations but has the same disadvantages outlined hereinabove, i.e. the weight of the switch section adjacent the main track subjects the lifting and lining tools as well as their drives to excessive strains, which unfavorably affects the accuracy of the desired track position. In an effort to alleviate such strains on the tools, it has been proposed to use lifting winches for the branch track section in cases of particularly heavy track switches but this requires additional operating personnel and also considerably slows down the work. The winches must be dismantled and erected again intermittently as the machine proceeds from tamping stage to tamping stage, which is time-consuming and uneconomical.

U.S. Pat. No. 4,342,263, dated Aug. 3, 1982, discloses a track leveling, lining and tamping machine whose track lifting and lining unit has a two-part tool carrier frame with a central pole attaching the unit to the machine frame. The lower carrier frame part has a pair of flanged wheels at a rear end and the central pole projects from a front end thereof and is longitudinally displaceably connected to the machine frame. The upper carrier frame part is centrally linked to the lower part and is equipped with a transversely displaceable or pivotal lifting hook associated with each rail adjacent the flanged wheel. For vertical adjustment of the lifting hook, the upper part may be raised by an adjustment drive with respect to the lower part. The unit has two lifting and lining drives and a longitudinal displacement drive enables the unit to be displaced in the direction of the track with resect to the machine frame. Since the unit has only a single rail gripping member for each rail, heavy track sections cannot be handled with this machine. This machine is obviously even more seriously beset by all the disadvantages outlined hereinabove when subjected to the heavy weight of a branch track section adjacent a main track in a track switch.

A track leveling, lining and tamping machine with an even simpler track lifting and lining unit is disclosed in British Patent No. 2,140,061, published Nov. 21, 1984. This unit has one pair of flanged wheels serving as lining elements and a vertically and laterally adjustable rail gripping member, such as a hook or roller, may be selectively engaged with the field side of each rail for cooperation with the associated flanged wheel. The machine has all the disadvantages outlined hereinabove when it comes to handling difficult and/or heavy track switches.

SUMMARY OF THE INVENTION

It is the primary object of this invention to obviate the above and other disadvantages in a mobile track working machine of the first-described type and to provide such a machine with an arrangement assuring secure gripping of the rail heads or foots to impart thereto the capability of operating in the heaviest track switches with a very high degree of safety and effectiveness. This enables the machine to work in switch areas where long ties still connect the branch track to the main track, i.e. in very heavy track switch sections, while providing improved track leveling and lining results in an economical manner.

The above and other objects are accomplished in such a machine according to one aspect of the invention by providing the lifting apparatus with a further transversely and vertically adjustable rail gripping hook mounted on the tool carrier frame, associated with each rail and spaced from the first rail gripping hook in the operating direction, and independent drives are connected to each rail gripping hook for independent vertical and lateral adjustment thereof.

According to another aspect of the present invention, a mobile track leveling, lining and tamping machine comprises a machine frame mounted for mobility in an operating direction on a track including two rails fastened to ties defining cribs therebetween, each rail having a rail head, a field side and a gage side, and an apparatus mounted on the machine frame for lifting a switch section laterally adjacent the track, the apparatus comprising rail gripping means for engaging the a respective switch section rail, and drive means for laterally displacing the rail gripping means with respect to the machine frame for alignment with the switch section rail.

Such an improved mobile track working machine can be used for lifting and laterally moving heavy track switches, including tracks with concrete ties, since the four independently adjustable rail gripping hooks, in addition to optionally used rail gripping rollers, make it possible to grip each rail by at least one hook even where difficult obstacles are in the way, such as frogs and the like switch elements. This assures secure and dependable track lifting to an accurate level, with a concomitant simplification of the lining. In less complex track sections, all four rail gripping hooks may engage the track rails to provide four support points, which considerably reduces the strain on the rail fasteners as well as on each individual lifting hook. Such a lifting apparatus may, therefore, be used to great advantage in heavy track leveling, lining and tamping machines designed for operation in track switches to assure precise leveling and lining thereof. The further rail gripping hook obviates the necessity of a time-consuming repetition of the lifting procedure when the rail glides off the one hook, which may happen when the one hook improperly engages the rail head in a difficult section of the switch. If only one of the hooks can be engaged with the associated rail, it helps to provide a gripping roller, too, to relieve the engaged hook and transmit lining force precisely to the track.

With the track leveling, lining and tamping machine of this invention, which is equipped with a leveling and lining reference system, much more accurate results are achieved since it is possible to lift the switch section laterally adjacent the main track independently with the main track, the weights of the main track and the adjacent switch section being distributed over the rail gripping means of the laterally displaceable lifting apparatus and the rail hooks engaging the rails of the main track. Therefore, a much wider track section may be effectively lifted than was heretofore possible and the strain on the lifting hooks and/or rollers gripping the main track rails is considerably reduced. Lining is correspondingly improved and made more accurate because it may be effected while the switch including the main and branch tracks is raised, which considerably reduces the required lining forces since the heavy branch track section no longer drags on the main track.

BRIEF DESCRIPTION OF THE DRAWING

The above and other objects, advantages and features of the invention will be described in more detail in connection with the accompanying drawing illustrating some now preferred embodiments thereof and wherein

FIG. 9 is a schematic, fragmentary side view of a track leveling, lining and tamping machine incorporating a switch tamping unit, a track lifting and lining unit as well as a lifting apparatus for a track branching off the main track at the switch section;

FIG. 10 is an enlarged schematic top view showing the tamping, lifting and lining operation of this machine; and FIG. 11 is a cross section along line XI—XI of FIG. 10.

DESCRIPTION OF THE PREFERRED EMBODIMENTS

Figures 1, 2, 3:
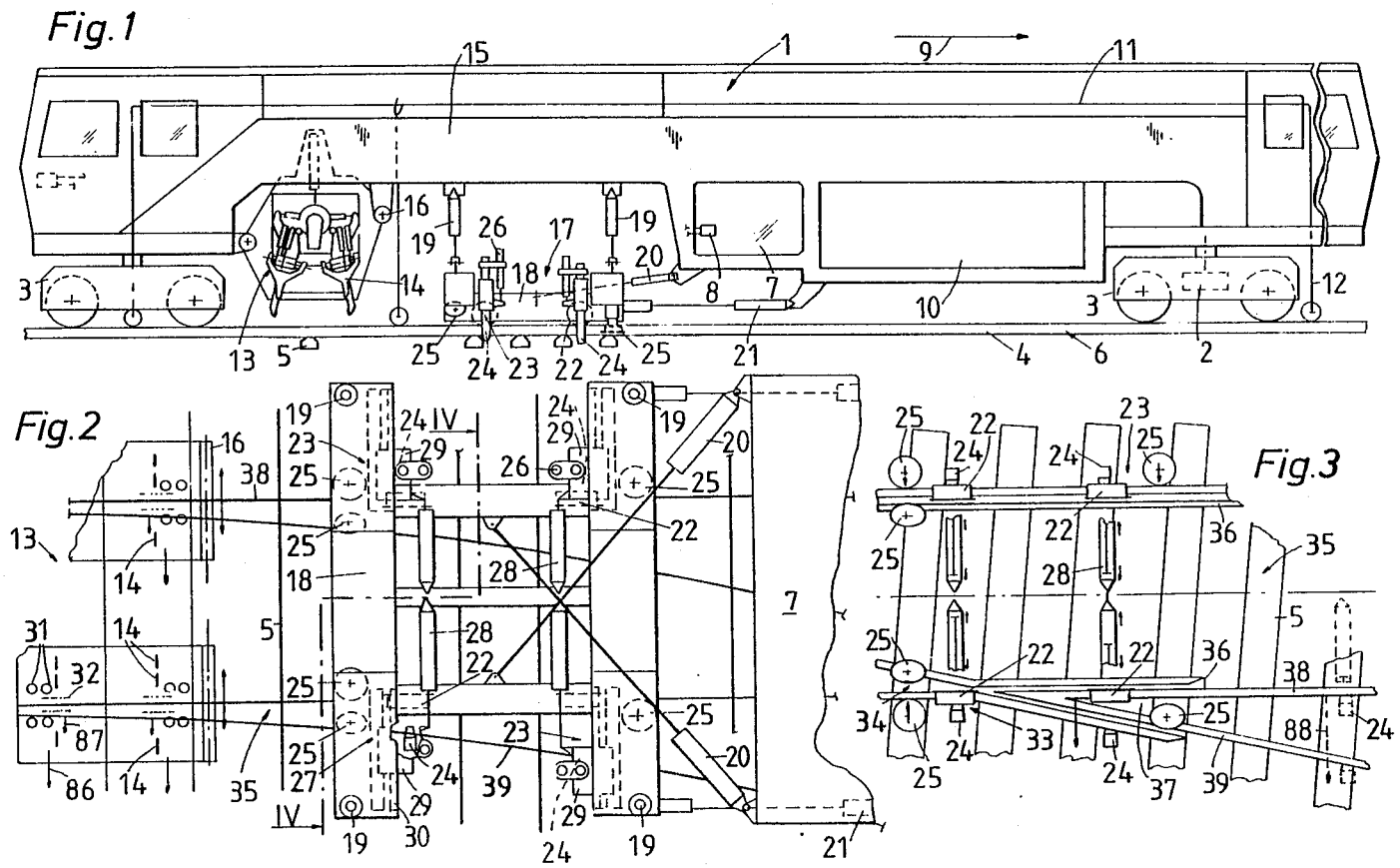
FIG. 1 is a somewhat schematic side view of a track leveling, lining and tamping machine with a switch tamping unit and an apparatus for lifting and laterally moving the track in a switch section according to one embodiment of the present invention.
FIG. 2 is an enlarged, fragmentary top view of the machine of FIG. 1, showing the lifting apparatus and schematically illustrating the switch tamping units.
FIG. 3 is a fragmentary top view schematically illustrating the operation of the rail gripping devices in a track switch.

Referring now to the drawing and first to FIG. 1, there is shown a mobile track working machine constituted by track leveling, lining and tamping machine 1 suitable for operation in track switches and crossings. The machine comprises machine frame 15 mounted for mobility in an operating direction indicated by arrow 9 on track 6 including two rails 4 fastened to concrete ties 5 defining cribs therebetween. Each rail has a rail head, a field side and a gage side. Swivel trucks 3 support opposite ends of the machine frame on the track and a drive 2 propels the machine therealong. Operator's cab 7 is mounted on the machine frame between the machine frame ends within view of the operating tools and is equipped with control panel 8 for operating the tool drives. Two engineer's cabs are mounted on machine frame 15 at the opposite ends and power plant 10 providing power to the various tool drives and the machine drive precedes cab 7 in the operating direction. Machine 1 is equipped with leveling reference system 11 comprising a tensioned wire supported on the track rails by rail sensing rollers 12. Immediately preceding rear swivel truck 3, a respective track tamping unit 13 associated with each rail 4 is vertically adjustably mounted on machine frame 15 and each unit comprises eight laterally pivotal tamping tools 14 to enable tie tamping to be effected in switches. The reciprocatory and vibratory tamping tools are independently pivotal about axes 32 extending in the direction of the track by independently operable pivoting drives 31 (see FIG. 2). To enable tamping tools 14 to be properly centered in respective operating positions in the switch, tamping units 13 are transversely displaceable along guide rods 16 affixed to the machine frame.

Apparatus 17 for lifting and laterally moving track 6 in a switch section is mounted on machine frame 15 between the track tamping units and operator's cab 7, i.e. it precedes the tamping units in the operating direction. This apparatus comprises vertically and laterally movable tool carrier frame 18 and power-actuated drives 19, 20 linking the tool carrier frame to machine frame 15 for vertically and laterally moving the tool carrier frame with respect to the machine frame. In the embodiment of FIG. 1, the power-actuated drives comprise two hydraulic lining drives 20 and four hydraulic lifting drives 19. The lifting drives are arranged above rail gripping rollers 25 so that the lifting force is uniformly transmitted thereto from the machine frame 15. Furthermore, two power-actuated, i.e. hydraulic, longitudinal displacement drives 21 link tool carrier frame 18 to machine frame 15 to enable apparatus 17 to be longitudinally displaced with respect to the machine frame. Two pairs of flanged wheels 22 support tool carrier frame 18 for mobility on track 6, the two flanged wheels associated with each track rail 4 and serving as track lining elements being spaced from each other in the operating direction. A respective rail gripping device 23 including two rail gripping members of different types, i.e. rail gripping hooks 24 and rail gripping rollers 25, is associated with each flanged wheel 22 for engagement with rail 4. In the embodiment of FIG. 1, there are four rail gripping hooks 24, one for each gripping device, and six rail gripping rollers 25, a single roller for each leading rail gripping device and pairs of rollers for each trailing rail gripping device. The provision of a single rail gripping roller for each rail gripping device simplifies the structure while still assuring a secure clamping of the rails at the leading end of switch 35 for dependably transmitting the lining forces to the track, the rail gripping rollers engaging the rails at four points. The two leading rail gripping rollers 25 engaging the field sides of rails 4 will prevent any torsion moment to be transmitted to tool carrier frame 18. Rail gripping hooks 24 associated with each rail 4 are spaced from each other a distance corresponding to at least one crib width. The rail gripping hooks are independently transversely and vertically adjustable, and independent drives 26, 28 are connect to each rail gripping hook for independent vertical and lateral adjustment thereof.

Vertical hydraulic adjustment drives 26 enable the spaced rail gripping hooks to be lowered for engagement of the rail base or foot by the hooks, which is particularly advantageous for lifting very heavy track sections since the hooked engagement of the rail feet prevents any tilting moment to be transmitted to the rails. Lateral hydraulic adjustment drives 28, compared to a mere pivotal movement of the hooks without vertical adjustment, enable a respective rail gripping hook to be transversely displaced into a position wherein it may engage an associated rail of a track section branching off the main track whereon flanged wheels 22 run. In this manner, the four rail gripping hooks will grip the four rails of the switch and thus more securely hold the entire switch section for a more accurate leveling and lining result. The independent vertical and lateral adjustability of the gripping hooks adapts the apparatus to operation in complex switches because each hook may be properly positioned for rapid and secure engagement with each rail at points available without obstacles. For example, in the range of the frog, one of the rail gripping hooks 24 may be held in engagement with the outer rail of the branch track at an available point until there is enough room between the main and branch tracks to permit the hook to enter therebetween. This opens the possibility that the hooks may engage the rails close to the heart of the switch for lifting, which eliminates high tilting moments. Since two spaced hooks are associated with each rail, it is almost always possible to adjust at least one of them vertically for engagement with the rail foot. The minimum distance of one crib width between the gripping hooks assures that the lifting force of the four hooks will be distributed over a large number of rail fastening elements so as to relieve each such element of excessive loads. Such an apparatus is, therefore, ideally suited for even the heaviest track leveling, lining and tamping machines for work in the most difficult track sections and switches, the independently adjustable tamping tools enabling the ballast to be tamped under the leveled and lined ties in the switch.

As will be seen in FIG. 2, each leading rail gripping device includes a single rail gripping roller 25 for subtending the rail head at the field side of associated rail 4 while each trailing rail gripping device 23 includes a pair 27 of rail gripping rollers for subtending the rail head of the associated rail at the field side and the gage side thereof. A vertical guide member 29 vertically adjustably holds each rail gripping hook 24 and transverse guide posts 30 affixed to tool carrier frame 18 laterally displaceably support the guide member to enable each rail gripping hook to be laterally displaced.

As can be seen in FIG. 3, two lining and rail gripping devices 33 each consisting of a rail gripping hook 24 and a flanged wheel 22 are associated with each rail and are spaced from each other in the operating direction. Devices 33 are arranged between single gripping rollers 25 and pairs 34 of gripping rollers 25 respectively engageable with the field and gage sides of the rails. Compared to the position shown in FIG. 2, apparatus 17 is illustrated in FIG. 3 in the center of switch 35, where track 39 branches off main track 38 and which holds wheel guide rail 36 and frog 37. These four lining and rail gripping devices each combined with at least one rail gripping roller make it possible securely to clamp the rails at four point from their field and gage sides so that the entire switch is held in a secure vise.

Figure 4:
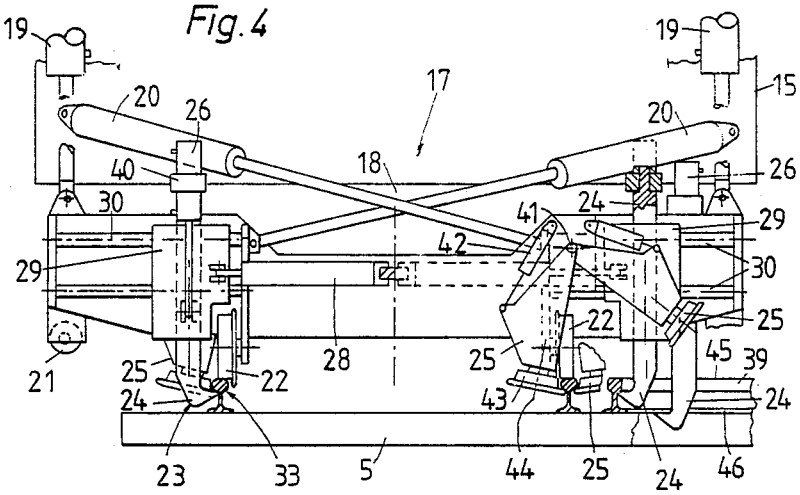
FIG. 4 is an end view along line IV—IV of FIG. 2, showing structural details of the lifting apparatus.

FIG. 4 shows the structural details of apparatus 17 in more detail. An upper end of rail gripping hook 24 projecting from guide member 29 carries connecting element 40 for connection to vertical adjustment drive 26. This is an hydraulic cylinder-piston drive whose piston rod is affixed to the guide member. In this manner, the hook, its vertical adjustment drive and the guide member are transversely displaceable together along guide posts 30. Each rail gripping roller 25 is mounted on tool carrier frame 18 for pivoting about axis 41 extending in the longitudinal direction of the track. Hydraulic pivoting drives 42 are connected to the rail gripping rollers for pivoting the same into a gripping position wherein their lifting plates 43 subtend an associated rail head, the lifting plates being rotatable about axes 44 extending perpendicularly to a plane defined by each plate. Each gripping hook 24 has a length enabling its hooked lower end to engage either rail head 45 or rail foot 46.

Figure 5:
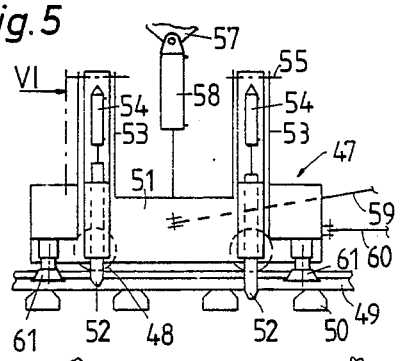
FIG. 5 is a side elevational view of another embodiment of a lifting apparatus.
Figure 6:
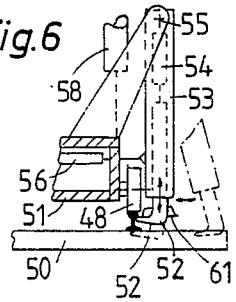
FIG. 6 is a fragmentary cross section along line VI of FIG. 5.

FIGS. 5 and 6 illustrate apparatus 47 for lifting and laterally moving a track consisting of two rails 49 fastened to concrete ties 50. The apparatus comprises vertically and laterally movable tool carrier frame 51 and power-actuated drives 58 and 59 linking the tool carrier frame to machine frame 57. Two pairs of flanged wheels 48 support the tool carrier frame for mobility on the track and serve as lining elements. A respective rail gripping device for engagement with the rail is associated with each flanged wheel 48 and includes rail gripping hook 52 and rail gripping roller 61 each engageable with the field side of the associated rail. Each rail gripping hook is longitudinally displaceably mounted in respective guide part 53 which is laterally pivotally arranged on tool carrier frame 51 for pivoting about axis 55 extending in the direction of the track. The guide part holds vertical adjustment drive 54 for vertically moving the gripping hook for longitudinal displacement in the guide part, and lateral adjustment drive 56 is connected to the guide part for pivoting the same between the positions shown in full and chain-dotted lines in FIG. 6. Operation of drive 54 enables rail gripping hook to be vertically adjusted in the pivotal guide part so that, when obstacles are encountered along the rail of the main track, the rail gripping hook may be suitably repositioned for gripping an adjacent rail of the branch track, thus assuring secure lifting of the entire switch. A respective rail gripping roller 61 is associated with each flanged wheel 48 and cooperating rail gripping hook 52, each gripping roller being laterally pivotal into engagement with the associated rail about an axis extending in the direction of the rail by a hydraulic pivoting drive. The combined lateral pivoting and vertical moving arrangement for the gripping hook makes the apparatus very robust and relatively simple in construction so that apparatus 47 may be used for very heavy loads. The arrangement again provides a four-point rail engagement, at least one of the rail gripping members associated with each flanged wheel lining element being engageable with the associated rail even in complex switches.

In a simplified arrangement of the power-actuated drives linking tool carrier frame 51 to machine frame 57, this embodiment uses only a respective hydraulic drive 58 arranged centrally between, and above, rail gripping hooks 52 associated with each rail 49, and two lining drives linked to the tool carrier frame between the rail gripping tools (and only diagrammatically indicated by their piston rods). In addition, two longitudinal displacement drives 60 link tool carrier frame 51 to machine frame 57. This simplified linkage of the tool carrier frame to the machine frame still assures an equilibrium of lifting and lining forces distributed uniformly over the four track engagement points.

Figure 7:
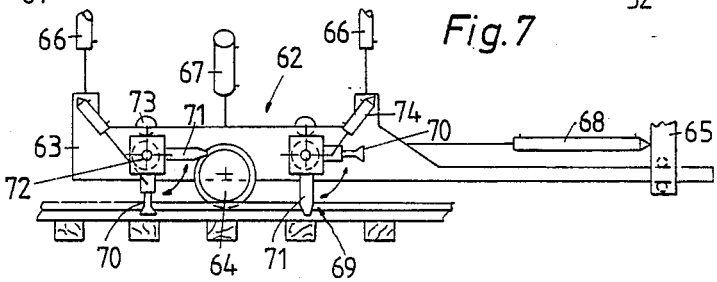
FIGS. 7 and 8 are schematic side views of two further embodiments of a lifting apparatus.

In the embodiment of FIG. 7, apparatus 62 for lifting and laterally moving the track comprises vertically and laterally movable tool carrier frame 63 which has a forwardly projecting central pole longitudinally displaceably mounted on machine frame 65. The power-actuated drives linking tool carrier frame 63 to machine frame 65 for vertically and laterally moving the tool carrier frame with respect to the machine frame comprise respective hydraulic lining drive 67 associated with each rail and arranged between the two rail gripping devices 69 associated with each rail and above flanged wheels 64 supporting the tool carrier frame for mobility on the track, a respective flanged wheel being associated with each rail and serving as track lining element. A respective lifting drive 66 is associated with each rail above the four rail gripping devices. Rail gripping devices 69 respectively precede and trail respective flanged wheel 64, and each device includes rail gripping hook 71 and mushroom-shaped rail gripping member 70 subtending the rail head in the operative position, hook 71 and member 70 enclosing an angle of 90° alternative use. Hydraulic drive 68 connects the front end of the tool carrier frame to the machine frame for longitudinal displacement with respect thereto so that the two rail gripping hooks may be positioned between successive ties and thus be enabled to grip the rails at their base. Rail gripping devices 69 are axially displaceably and rotatably mounted on guide posts 72 extending transversely to the track and are connected to transverse displacement drive 73 enabling them to be transversely adjusted. Furthermore, hydraulic pivoting drive 74 is connected to each rail gripping device 69 to rotate the same about transverse guide post 72. In this manner, as shown in FIG. 7, rail gripping hook 71 and mushroom-shaped rail gripping member 70 may be selectively rotated in their rail engaging operative position, thus enabling the associated rail to be gripped in a manner suitable to prevailing operating conditions. In contrast to the gripping rollers used in the previously described embodiments, mushroom-shaped rail gripping members 70 are simple carrier bolts with a symmetrical bead at their free ends designed to subtend the rail head. Rail gripping devices with such a simple gripping member can be only used for operation in medium-weight switches but they have the advantage of added adaptability to various rail conditions, using either the hook or the mushroom-shaped gripping member and being further able to avoid a minor obstacle at the rail gripping point by a slight longitudinal displacement of the tool carrier so that the respective rail gripping device avoids this obstacle. Apparatus 62 is advantageously used in light track leveling, lining and tamping machines combined, for example, with a switch tamping unit using only eight independently adjustable tamping tools.

Figure 8:
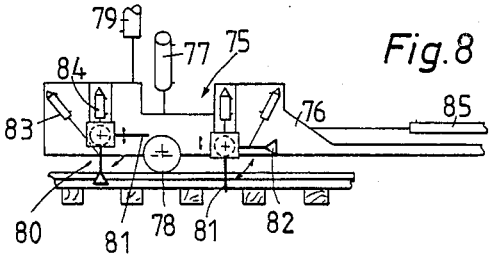

As shown in FIG. 8, apparatus 75 for lifting and laterally moving a track is similar to that of FIG. 7 and comprises vertically and laterally movable tool carrier frame 76 which also has a forwardly projecting pole for attachment to a machine frame and longitudinal displacement drive 85 enabling the tool carrier frame to be longitudinally displaced with respect to the machine frame. The power-actuated drives linking tool carrier frame 76 to the machine frame for vertically and laterally moving the tool carrier frame with respect to the machine frame comprise respective hydraulic lifting drive 79 and hydraulic lining drive 77 associated with each rail and arranged between the two rail gripping devices 80 associated with each rail. The lining drives are arranged above flanged wheels 78 supporting the tool carrier frame for mobility on the track, a respective flanged wheel being associated with each rail and serving as track lining element. This arrangement of the lining drives assures the transmission of the lining forces directly to the flanged wheels for applying the lining pressure to the rails engaged thereby. Rail gripping devices 80 respectively precede and trail respective flanged wheel 78, and each device includes rail gripping hook 81 and mushroom-shaped rail gripping member 82 subtending the rail head in the operative position, as in the embodiment of FIG. 7. Rail gripping devices 80 are vertically adjustable by vertical adjustment drives 84 connected thereto and are rotatable about an axis extending transversely to the track. Hydraulic pivoting drive 83 is connected to each rail gripping device 80 to rotate the same. In this manner, rail gripping hook 81 and mushroom-shaped rail gripping member 82 may be selectively rotated in their rail engaging operative position, as explained in connection with FIG. 7. The vertical adjustment of the rail gripping devices enables hooks 71 to engage either the rail head or the rail foot. This embodiment is useful under operating conditions similar to those mentioned hereinabove in connection with the embodiment of FIG. 7.

The operation of a track leveling, lining and tamping machine equipped with an apparatus for lifting and laterally moving the track according to the present invention will now be described in detail in connection with machine 1 and apparatus 17 shown in FIGS. 1 to 4:

The operation of the machine is controlled from control panel 8 by an operator in cab 7. As soon as machine 1 has been moved into an initial section of switch 35 (FIG. 2) along main track section 38, rail gripping rollers 25 above branch track 39 are pivoted upwardly out of the range of the rails. The two rail gripping hooks 24, which are to engage the outer rail of branch track 39 (shown at the bottom of FIG. 2), are transversely outwardly displaced by drives 28 along guide posts 30 until each gripping hook is aligned with this branch track rail for firm engagement of the hook with the rail. Leading rail gripping hook 24, which is positioned between two successive tie 5, may be lowered by vertical adjustment drive 26 connected thereto to enable the hooked end of the hook to engage foot 46 (see FIG. 4) of the rail. In the operating position shown in FIG. 2, heavy switch 35 is gripped by three gripping rollers 25 engaging the field sides of rails 4 of main track 38, one gripping roller 25 engaging the gage side of one of the main track rails and all four gripping hooks 24 cooperating with the four flanged wheels 22 opposite the gripping hooks and wherebetween the rails are clamped without play. The four lifting drives 19 are then actuated under control of reference system 11 until adjacent rail sensing roller 12 indicates the desired level. At the same time, any lining errors by be corrected by actuation of lining drives 20, also under the control of a lining reference system not shown herein.

As soon as the initial portion of switch 35 has thus been leveled and lined, it is fixed in the corrected position by tamping ballast under tie 5 positioned between tamping tools 14. To make the tamping operation possible, those tamping tools which are positioned above branch track 39 are pivoted upwards by pivoting drives 31 into a rest position, as shown by arrow 86. Adjacent tamping tools 14 are slightly upwardly pivoted by their drives 31 to enable them to be immersed in the ballast adjacent tie 5 despite the presence of the switch tongue. The two tamping tools along the opposite tie edge may be immersed in the ballast in their regular vertical position since no obstacle is in their way. To enable tamping assemblies 13 to be centered accurately with respect to the rail they straddle, they are transversely displaceable along guide posts 16.

FIG. 3 illustrates the position of rail gripping devices 23 after machine 1 has been advanced into the center of switch 35. In this position, two of the trailing and one of the leading rail gripping rollers 25 have been pivoted up into their rest positions since wheel guiding rails 36 and the outer rail of branch track 39 constitute obstacles which make engagement of these rollers with the associated rails impossible. Two of the rail gripping hooks 24 associated with one rail and the trailing rail gripping hook 24 associated with the other rail are displaced into their transversely most retracted position for engagement with the associated rails while leading rail gripping hook 24 associated with the other rail has been transversely displaced outwardly, as shown by an arrow, so that it may engage wheel guiding rail 36 of branch track 39 at the field side and at its foot. Thus, the four gripping devices 23 will securely grip heavy switch 35 with four hooks and three rollers even in this very difficult track section encompassing wheel guiding rail 36 and frog 37. Arrow 88 (in broken lines) shows how gripping hook 24 may be repositioned from its innermost location in alignment with main track section 38 to its outermost location in alignment with branch track section 39. This transverse end positions of the rail gripping hook indicate clearly that the outer rails of the switch may be gripped so that heavy switch 35 may be lifted precisely while held at eccentric points at both sides of its point of gravity. After machine 1 is advanced beyond the position of FIG. 3, leading gripping hook 24 is again inwardly displaced from the extreme outward position and is vertically adjusted to enable it to grip the field side of the rail of main track section 38.

Machine 1 may also be used for leveling, lining and tamping tangent track 6, for which purpose only the six rail gripping rollers 25 will be used for lifting although, if need be, gripping hooks 24 may also be utilized.

FIG. 9 shows track leveling, lining and tamping machine 101 suitable for operation in track switches and crossings. The machine comprises machine frame 115 mounted for mobility in an operating direction indicated by arrow 109 on track 106 including two rails 104 fastened to concrete ties 105 defining cribs therebetween. Swivel trucks 103 support opposite ends of the machine frame on the track and a drive 102 propels the machine therealong. Operator's cab 107 is mounted on the machine frame between the machine frame ends within view of the operating tools and is equipped with control panel 108 for operating the tool drives. Two engineer's cabs are mounted on machine frame 115 at the opposite ends and power plant 110 providing power to the various tool drives and the machine drive precedes cab 107 in the operating direction. Machine 101 is equipped with leveling reference system 111 comprising a tensioned wire supported on the track rails by rail sensing rollers 112. Immediately preceding illustrated rear swivel truck 103, a respective switch tamping unit 113 associated with each rail 104 is vertically adjustably mounted on machine frame 115 and each unit comprises eight laterally pivotal tamping tools 114 to enable tie tamping to be effected in switches. The reciprocatory and vibratory tamping tools are independently pivotal about axes 132 extending in the direction of the track by independently operable pivoting drives 131 (see FIG. 10). To enable tamping tools 114 to be properly centered in respective operating positions in the switch, tamping units 113 are transversely displaceable along guide rods 116 affixed to the machine frame.

Track lifting and lining unit 117 for lifting and laterally moving track 106 is mounted on machine frame 115 between the track tamping units and operator's cab 107, i.e. it precedes the tamping units in the operating direction. This apparatus comprises vertically and laterally movable tool carrier frame 118 and power-actuated drives 119, 120 linking the tool carrier frame to machine frame 115 for vertically and laterally moving the tool carrier frame with respect to the machine frame. In the embodiment of FIG. 9, the power-actuated drives comprise two hydraulic lining drives 120 and four hydraulic lifting drives 119. The lifting drives are arranged above rail gripping rollers 125 so that the lifting force is uniformly transmitted thereto from the machine frame 115. Furthermore, two power-actuated, i.e. hydraulic, longitudinal displacement drives 121 link tool carrier frame 118 to machine frame 115 to enable track lifting and lining unit 117 to be longitudinally displaced with respect to the machine frame. The tool carrier frame supports rail engaging elements for lining and lifting the track, including two pairs of flanged wheels 122, which support tool carrier frame 118 for mobility on track 106, the two flanged wheels associated with each track rail 104 and serving as track lining elements being spaced from each other in the operating direction, and a respective rail gripping device 123 including two rail gripping members of different types, i.e. rail gripping hooks 124 and rail gripping rollers 125, is associated with each flanged wheel 122 for engagement with rail 104.

As shown in FIG. 10, each of the four spaced rail gripping devices 123 of track lifting and lining unit 117 comprises a gripping hook 124 and a pair of cooperating, laterally pivotal gripping rollers 125 for respective engagement with the field side and the gage side of the associated rail. The pairs of gripping rollers of trailing gripping devices 123 are arranged rearwardly of their gripping hooks while the pairs of gripping rollers of the leading gripping devices are arranged forwardly of their gripping hooks. The two rail gripping hooks 124 associated with each rail are spaced in the operating direction a distance corresponding to at least one crib width, preferably two crib widths. Each rail gripping hook has its own vertical adjustment drive 126 and transverse displacement drive 128 for independent vertical and lateral adjustment of each rail gripping hook. A vertical guide member 129 vertically adjustably holds each rail gripping hook 124 and transverse guide posts 130 affixed to tool carrier frame 118 laterally displaceably support the guide member to enable each rail gripping hook to be laterally displaced. Each gripping roller 125 is pivotally mounted on tool carrier frame 118 and is pivotal about axis 141 extending in the operating direction by hydraulic pivoting drive 142. The lower end of each gripping roller carrier lifting plate 143 arranged to subtend a respective rail head when pivoted into engagement with the associated rail and the lifting plate is rotatable about axis 144 extending perpendicularly to the plane defined by the plate. The length of each gripping hook 124 is such that its end hook may engage either the rail head or foot.

Track lifting and lining unit 117 further comprises apparatus 127 for vertically and laterally moving a track switch section laterally adjacent machine 101 in a switch, which is arranged between the leading and trailing rail gripping hooks 124. Apparatus 127 comprises rail gripping means constituted by rail gripping hooks 138 for engaging track rails 134 and drive means 146 for laterally displacing the lifting apparatus with respect to the machine frame for alignment with the switch section. Rail gripping hook 138 is vertically adjustable and drive 137 is connected thereto for vertically adjusting the hook. Such a track leveling, lining and tamping machine makes a very accurate track position correction in switches possible since the switch section adjacent to the main track will be engaged for lifting so that its weight will not unfavorably influence the switch lifting operation. The additional lifting apparatus thus enables the track lifting and lining unit to engage a much wider track section than would otherwise be possible, which also reduces the load on the rail gripping hooks and rollers engaging the main track rails. Lining is made more accurate because it can be effected with a fully raised switch. Mounting this additional lifting apparatus on the vertically and laterally movable tool carrier frame of the track lifting and lining unit provides a particularly simple and advantageous structure since the lifting apparatus is vertically adjustable with this unit so that they may be adjusted together during a lifting operation as well as when they are raised during the movement of the machine from one operating site to another. Equipping the machine with switch tampers enables the switch to be fixed in the corrected position in a single operating stage.

The operation of machine 101 will be best understood from FIG. 10 showing the machine located in switch 135 formed by main track 106 and branch track 133 laterally adjacent thereto. Lifting apparatus 127 is designed to engage this branch track and, as best shown in FIG. 11, comprises cantilevered beam 136 telescopingly mounted on tool carrier 118, rail gripping hook 138 being arranged at an outer end of the beam. The lateral displacement drive means includes power-actuated drive 146 for laterally displacing beam 136. Tubular carrier body 145 is affixed to tool carrier frame 118 and telescopingly receives and guides beam 136 which also is tubular. Cylinder-piston drive 146 extends in the tubular carrier body and beam, having one end linked to the carrier body 145 and an opposite end linked to beam 136. Lateral displacement path 147 of lifting apparatus beam 136 preferably corresponds to about one regular tie length. FIGS. 10 and 11 illustrate cantilevered beam 136 in its laterally extended position in alignment with branch track 133 and rail gripping hook 138 lowered into a position for engaging the foot of rail 134 of the branch track. As shown in FIG. 11, lifting apparatus 127 further comprises vertically adjustable lifting jack 139 having support shoe 149 pivotally attached to a lower end thereof, the lifting jack being mounted at the outer beam end laterally outwardly of rail gripping hook 138 and vertical adjustment drive 148 being connected thereto for vertical adjustment thereof. In this manner, the lifting in this heaviest portion of switch 135 is effected with four gripping hooks 124 engaging both rails 104 of main track 106, gripping hook 136 of lifting apparatus 127 engaging one of the rails of branch track 133 at its foot, two pairs of gripping rollers 125 engaging the rail head of one rail 104 and one pair of gripping rollers 125 and one additional gripping roller 125 engaging the rail head of the other rail 104. Thus, the arrangement of lifting apparatus 127 between the leading and trailing rail gripping hooks of the track lifting and lining unit assures very secure and accurate lifting in wide track sections including long ties while, at the same time, alleviating excess stress on individual rail gripping members and rail fastening elements.

The telescoping cantilevered beam provides not only a very robust lifting apparatus but also is readily adjustable so that it may be operated in case of need while remaining in a rest position without interfering with the normal lifting and lining unit operation. It may also be readily retrofitted in existing units. The arrangement of the lifting jack at the outermost end of the cantilevered beam provides an additional support which relieves any bending stress on the beam during lifting. The structure of the rail gripping hook on the additional lifting apparatus is preferably the same as on the track lifting and lining unit.

Illustrated lifting apparatus 127 comprises two like cantilevered beams 136 whose guide bodies 145 are arranged immediately adjacent and parallel to each other, and the drive means therefor includes two like drives 146 for respectively displacing a respective beam laterally to a respective side of track 106, depending from which side track 133 branches off main track 106. This arrangement further enhances the adaptability of the apparatus to different track conditions. In this manner, it is not necessary to lose time in redirecting the machine in one or the other direction but it can be immediately adapted to operation at either side of the main track.

Mobile track leveling, lining and tamping machine 101 further comprises a conventional leveling reference system 111 as well as a lining reference system controlling the operation of the lifting and lining elements 124, 125 as well as rail gripping hooks 138 of lifting apparatus 127. Undercarriages 103 supporting the machine frame on the track, and wherebetween tool carrier frame 118 for track lifting and lining unit 117, lifting apparatus 127 and switch tamper 113 is arranged, are spaced sufficiently in the operating direction to permit the required vertical and lateral movement of the track rails during the leveling and lining operation. This enables the lifting and lining to be so controlled and coordinated that the accuracy of the desired switch position is assured.

Track leveling, lining and tamping machine 101 is operated in the following manner:

An operator in cab 107 mans control panel 108 to control the drives of all operating tools. As soon as machine 101 has been moved into an initial section of switch 135 (FIG. 10) along main track section 106, those rail gripping rollers 125 above branch track 133 which encounter obstacles are pivoted upwardly out of the range of the rails (see the one gripping roller 125 at lower rail 104 of main track section 106). All four rail gripping hooks 124 can engage the field sides of rails 104 of the main track section and are transversely outwardly displaced by drives 128 along guide posts 130 until each gripping hook is aligned with an associated rail for firm engagement of the hook with the rail. Subsequently or simultaneously, cantilevered beam 136 at the side of branch track 133 is laterally outwardly displaced until its gripping hook 138 is aligned with the field side of rail 134 of branch track 133 and vertical adjustment drive 137 lowers the hook into position for engagement with the foot of the rail in a crib of the branch track. In this position, drive 148 is actuated to lower lifting jack 139 into is supporting position wherein jack shoe 149 engages the ballast in the crib. In the operating position shown in FIG. 10, heavy switch 135 is gripped by seven gripping rollers 125 engaging the field and gage sides of rails 104 of main track section 106, and five gripping hooks, the four gripping hooks 124 cooperating with the four flanged wheels 122 opposite the gripping hooks and wherebetween the rails are clamped without play. The four lifting drives 119 are then actuated under control of reference system 111 until adjacent rail sensing roller 112 indicates the desired level. At the same time, any lining errors by be corrected by actuation of lining drives 120, also under the control of a lining reference system not shown herein.

As soon as the initial portion of switch 135 has thus been leveled and lined, it is fixed in the corrected position by tamping ballast under tie 105 positioned between tamping tools 114.

If the machine is used in tangent track sections, it will usually be sufficient to operate only with the four pairs of rail gripping rollers 125 although, where needed, any of the rail gripping hooks 124 may also be used.

What is claimed is:

1. A mobile track working machine comprising a machine frame mounted for mobility in an operating direction along a track including two rails fastened to ties defining cribs therebetween, each rail having a rail head, a rail foot, a field side and a gage side, and an apparatus for lifting and laterally moving the track in a switch section, the apparatus comprising (a) a vertically and laterally movable tool carrier frame, (b) power-actuated drives linking the tool carrier frame to the machine frame for vertically and laterally moving the tool carrier frame with respect to the machine frame, (c) a pair of flanged wheels supporting the tool carrier frame for mobility on the track,
(1) a respective one of the flanged wheels being associated with each track rail and serving as track lining element,
(d) a rail gripping device associated with each flanged wheel and mounted on the tool carrier frame for engagement with the field side of the associated rail, the rail gripping device including
(1) two rail gripping hooks transversely and vertically adjustable for selective engagement with the head or foot of the associated rail at the field side thereof and spaced from each other in the operating direction a distance corresponding to at least one average crib width, and
(e) independent drives connected to each rail griping hook for independent vertical and lateral adjustment thereof.

2. The mobile track working machine of claim 1, further comprising a rail gripping roller associated with each rail gripping hook.

3. The mobile track working machine of claim 2, further comprising a respective guide part for at least one of the rail gripping hooks associated with each rail, the rail gripping hook being longitudinally displaceably mounted in the guide part and the guide part being laterally pivotally arranged on the tool carrier frame, the vertical and lateral adjustment drives for the rail gripping hook comprising a drive for pivoting the guide part and a drive for vertically moving the rail gripping hook for longitudinal displacement in the guide part.

4. The mobile track working machine of claim 1, wherein the power-actuated drives linking the tool carrier frame to the machine frame comprise a respective hydraulic lifting drive arranged centrally between, and above, the rail gripping hooks associated with each rail, and lining drives linked to the tool carrier frame between the rail gripping hooks.

5. The mobile track working machine of claim 1, to the machine frame, and wherein the rail gripping hooks associated with each rail respectively precede and trail the respective flanged wheel, each rail gripping hook being pivotal about an axis extending transversely to the track and has affixed thereto a mushroom-shaped end for subtending the rail head, and wherein the power-actuated drives linking the tool carrier frame to the machine frame comprise a respective hydraulic lining drive associated with each rail and arranged between the rail gripping hooks and above the flanged wheels, and a respective lifting drive associated with each rail above the rail gripping hooks.

6. The mobile track working machine of claim 1 wherein the rail gripping hooks associated with each rail respectively precede and trail the respective flanged wheel, and the power-actuated drives linking the tool carrier frame to the machine frame comprise a respective hydraulic lining drive and a respective hydraulic lifting drive associated with each rail, the hydraulic drives being arranged between the rail gripping hooks and above the flanged wheels.

7. A mobile track leveling, lining and tamping machine comprising
(a) a machine frame mounted for mobility in an operating direction along a track including two rails fastened to ties defining cribs therebetween, each rail having a rail head, a rail foot, a field side and a gage side,
(b) a vertically and laterally movable tool carrier frame linked to the machine frame and supporting rail engaging and gripping elements spaced from each other in the operating direction and associated with each rail for lining and lifting the track, the tool carrier frame having flanged wheels supporting the tool carrier frame for mobility on the track, and
(c) an apparatus mounted on the tool carrier frame spaced from the rail engaging and gripping elements in the operating direction for lifting a switch section laterally adjacent the track, the switch section lifting apparatus comprising
(1) a vertically adjustable rail gripping hook for selectively engaging the rail head or foot of a respective rail of the switch section at the field side thereof,
(2) a drive for vertically adjusting the rail gripping hook for selective engagement with the rail head or foot, and
(3) drive means for transversely displacing the rail gripping hook with respect to the tool carrier frame for alignment with the switch section rail.

8. The mobile track leveling, lining and tamping machine of claim 7, wherein the lifting apparatus comprises a cantilevered beam telescopingly mounted on the tool carrier frame, the rail gripping hook being arranged at an outer end of the beam, and the drive means includes a power-actuated drive for laterally displacing the beam.

9. The mobile track leveling, lining and tamping machine of claim 8, further comprising a tubular carrier body affixed to the tool carrier frame and telescopingly receiving and guiding the cantilevered beam, the power-actuated drive being arranged in the tubular carrier body.

10. The mobile track leveling, lining and tamping machine of claim 8, wherein the lifting apparatus further comprises a vertically adjustable lifting jack having a support shoe at a lower end thereof, the lifting jack being mounted at the outer beam end laterally outwardly of the rail gripping hook.

11. The mobile track leveling, lining and tamping machine of claim 10, wherein the lifting apparatus comprises two like ones of said cantilevered beams arranged adjacent and parallel to each other, and the drive means includes two like ones of said drives for respectively displacing a respective one of the beams laterally to a respective side of the track.

12. The mobile track leveling, lining and tamping machine of claim 7, wherein the rail engaging elements on the tool carrier frame include two independently vertically and laterally adjustable rail gripping hooks spaced from each other in the operating direction and two independent drives for vertically and laterally adjusting the hooks, and the lifting apparatus is arranged on the tool carrier frame between the two rail gripping hooks of the lifting apparatus.

13. The mobile track leveling, lining and tamping machine of claim 7, further comprising respective undercarriages supporting opposite ends of the machine frame, the took carrier frame being arranged between the undercarriages, and a switch tamping unit arranged on the machine frame rearwardly of the tool carrier frame in the operation direction, the switch tamping unit comprising laterally pivotal tamping tools operable in switch sections.

14. The mobile track leveling, lining and tamping machine of claim 7, further comprising (a) power-actuated drives linking the tool carrier frame to the machine frame for vertically and laterally moving the tool carrier frame with respect to the machine frame, (b) a pair of said flanged wheels supporting the tool carrier frame for mobility on the track, (1) a respective one of the flanged wheels being associated with each track rail and serving as track lining element, (c) another rail gripping hook associated with each flanged wheel and mounted on the tool carrier frame transversely and vertically adjustably for engagement with the associated rail, (1) the rail gripping hook of the switch section lifting apparatus being spaced in the operating direction from the other rail gripping hook.

15. A mobile track working machine comprising a machine frame mounted for mobility in an operating direction along a track including two rails fastened to ties defining cribs therebetween, each rail having a rail head, a rail foot, a field side and a gage side, and an apparatus for lifting and laterally moving the track in a switch section, the apparatus comprising (a) a vertically and laterally movable tool carrier frame, (b) two hydraulic lining drives and four hydraulic lifting drives linking the tool carrier frame to the machine frame for laterally and vertically moving the tool carrier frame with respect to the machine frame, (c) two pairs of flanged wheels supporting the tool carrier frame for mobility on the track, (1) a respective one of the flanged wheels of each pair being associated with each track rail and serving as track lining element, (d) a rail gripping device associated with each flanged wheel and mounted on the tool carrier frame, each rail gripping device including (1) a rail gripping hook transversely and vertically adjustable for selective engagement with the head or foot at the field side of the associated rail, the rail gripping hooks at each associated rail being spaced from each other in the operating direction a distance corresponding to at least one average crib width, and (2) a pair of rail gripping rollers associated with each rail gripping hook, the rail gripping rollers of each pair cooperating for respectively subtending the rail head at the gage and field sides of the associated rail, the pairs of flanged wheels and associated rail gripping hooks being arranged between the pairs of rail gripping rollers, and (e) independent drives connected to each rail gripping hook for independent vertical and lateral adjustment thereof.

* * * * *